United States Patent [19]

Fulton

[11] 4,426,917

[45] Jan. 24, 1984

[54] METHOD OF AND APPARATUS FOR CONDITIONING THE ATMOSPHERE OF A SPACE

[75] Inventor: Robert Fulton, Maidenhead, England

[73] Assignee: Flakt Aktiebolag, Nacka, Sweden

[21] Appl. No.: 251,772

[22] Filed: Apr. 7, 1981

[30] Foreign Application Priority Data

Apr. 11, 1980 [GB] United Kingdom ..... 8012021

[51] Int. Cl.[3] ..... F24F 13/04

[52] U.S. Cl. ..... 98/38 B; 98/38 R

[58] Field of Search ..... 98/38 B, 38 D, 38 R, 98/38 E; 236/13; 165/16

[56] References Cited

U.S. PATENT DOCUMENTS

| | | | |
|---|---|---|---|
| 2,442,963 | 6/1948 | Sewell et al. | 98/38 E |
| 2,785,015 | 3/1957 | Van Den Broek . | |
| 3,327,605 | 6/1967 | Spoormaker | 98/38 B |
| 3,382,916 | 5/1968 | Laux | 98/38 E X |
| 3,455,378 | 7/1969 | Honnold, Jr. | 98/38 E X |
| 3,528,614 | 9/1970 | Honmann | 98/38 E X |
| 3,611,908 | 10/1971 | Spoormaker | 98/38 E |
| 3,881,402 | 5/1975 | Larkfeldt . | |
| 3,895,567 | 7/1975 | Paul | 98/38 |
| 3,946,647 | 3/1976 | Larkfeldt | 98/38 R |

FOREIGN PATENT DOCUMENTS

| | | | |
|---|---|---|---|
| 1102371 | 3/1961 | Fed. Rep. of Germany . | |
| 2216076 | 10/1973 | Fed. Rep. of Germany . | |
| 2348993 | 4/1975 | Fed. Rep. of Germany | 98/38 E |
| 2256999 | 11/1974 | France . | |
| 82594 | 10/1953 | Norway . | |
| 135913 | 4/1973 | Norway . | |
| 694533 | 7/1953 | United Kingdom . | |
| 1785868 | 11/1957 | United Kingdom | 98/38 |
| 1027774 | 4/1966 | United Kingdom . | |
| 1134513 | 11/1968 | United Kingdom . | |
| 1437833 | 6/1976 | United Kingdom . | |
| 1497899 | 1/1978 | United Kingdom . | |
| 1525473 | 9/1978 | United Kingdom . | |

*Primary Examiner*—William E. Tapolcai

*Attorney, Agent, or Firm*—Dann, Dorfman, Herrell and Skillman

[57] ABSTRACT

The invention relates to a method of and apparatus for conditioning the atmosphere of a space, in which ventilating air of the space 3 is mixed with heated or cooled air by induction round clusters of jets 8 which are fed with heated or cooled air from an independent source of air including a fan 5 and a heater or cooler 6.

8 Claims, 1 Drawing Figure

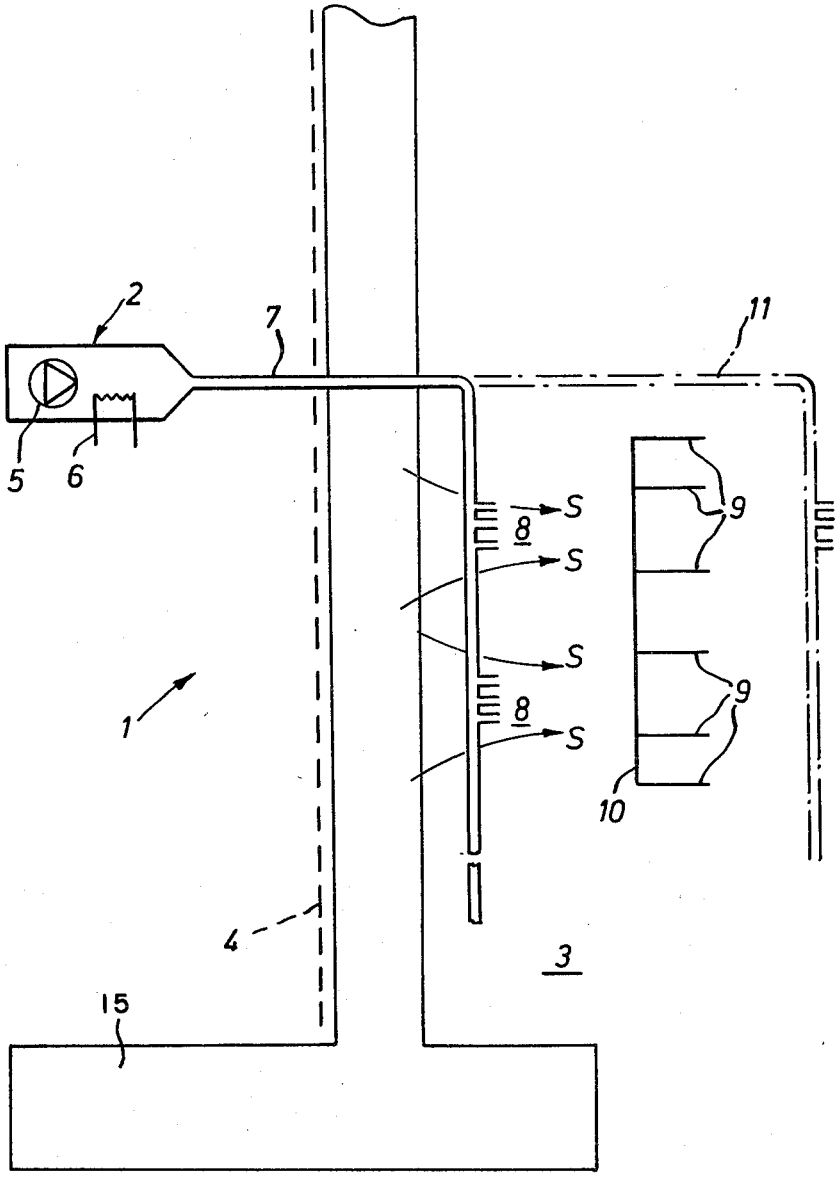
2
7
11
5
6
S
8
S
S
8
S
9
9
1
10
4
3
15

METHOD OF AND APPARATUS FOR CONDITIONING THE ATMOSPHERE OF A SPACE

TECHNICAL FIELD OF THE INVENTION

The invention relates to a method of and apparatus for conditioning a space.

BACKGROUND ART

It is known to heat air in a space being ventilated by admitting heated air to the space through venturi diffusers which also draw in air from the space, mix it with the heated air and pass the mixture to the space to provide ventilating air at a desired temperature.

However, this previous proposal has the disadvantage that there is a large temperature drop of the heated air, and also a large and therefore costly means such as a fan is required for passing the heated air to the venturi mixer(s).

DISCLOSURE OF THE INVENTION

It is an object of the invention to seek to mitigate these disadvantages of the prior art.

According to one aspect of the invention there is provided a method of conditioning the atmosphere of a space, comprising the steps of supplying ventilating medium to the space from a main supply means, and mixing the ventilating medium in the space with conditioned medium issuing from a plurality of jet supplied by an independent source such that the medium in the space attains a desired temperature.

According to a second aspect of the invention there is provided an apparatus for conditioning the atmosphere of a space, ventilating medium being supplied to the space from a main supply means, the apparatus comprising an independent source of conditioning medium, means to condition the medium connected with the source, and a plurality of jets connected to the conditioning means by ducting and directed into the space whereby conditioned medium can issue into the space and mix with ventilating medium in the space to condition that medium as desired.

The advantage which may be obtained using the invention is that it is not necessary to provide a powerful fan or a venturi mixer in order to condition the medium, usually air, in the space.

An embodiment of the invention is hereinafter described, by way of example, with reference to the accompanying drawing.

BRIEF DESCRIPTION OF THE DRAWING

The drawing shows schematically apparatus for conditioning ventilating air in a space by heating that air.

BEST MODES FOR CARRYING OUT THE INVENTION

Referring to the drawing there is shown apparatus 1 comprising an independent source 2 of conditioning medium in this case air. The source 2 is outside a space 3 being ventilated, a boundary wall of which is indicated at 4. The source 2 includes a fan 5, a heater 6, which may be a direct gas fired air heater, and ducting 7 which leads into the space 3. Inside the space 3 the ducting 7 leads to a plurality of jets 8 arranged in this case in clusters of three. There are two clusters 8, each of three jets, shown in the drawing.

There is also in the space a plurality of ejectors 9, shown schematically, which are fed by a common manifold 10 with ventilating medium and which provide air at a high speed and low volume compared with the ventilating medium from a main source (which is not shown).

In use, ventilating air is supplied to the space 3 from the main source. In order to heat the air to a desired degree, outside air is supplied by the independent source 2. The fan 5 forces the air over the heater 6 which heats it to say 150° C. and this heated air passes down the ducting 7 and then exits from the jets 8 at a temperature of about 50° C. The air flow from the jets 8 induces a flow of ambient air in the space as shown by the arrows "S". This induced ambient air and the heated air mix thoroughly and in doing so the ambient air in the space 3 is heated the desired amount, and passes through the space 3. The heated air is directed through the space by the air issuing from the ejectors 9, the air from the ejectors 9 being at a high speed and low volume as compared with the low speed and high volume of the ventilating air supplied to the space by the main source.

The apparatus 1 above described and shown in the drawing may be modified. For example, there may be more or less that three jets 8 in a cluster. Also, there may be one, or more than two clusters.

Further, there may be several sets of clusters in the space fed by the one source, as shown in phantom at 11.

It will also be understood that the term "conditioning" used herein embraces both heating, as described, and cooling of the atmosphere of a space. Thus for cooling the space, air supplied by the independent source 2 would be cooled by a cooling coil 6 and would then be mixed in the space with the atmosphere therein in order to cool that atmosphere to a desired temperature. Apart from the coil 6 being a cooling means, the apparatus corresponds with that shown and described for heating the space 3.

I claim:

1. A method of conditioning the atmosphere in the free space within a boundary wall comprising:

(a) providing a main supply means exterior of said space;

(b) supplying ventilating medium to said space from said main supply means;

(c) providing an independent source of conditioning medium externally of the space;

(d) providing a plurality of jets in said space independent of said main supply means;

(e) supplying conditioning medium from said independent source to said space via said jets;

(f) controlling the condition of the atmosphere within the free space to attain a desired temperature by mixing said ventilating medium and said conditioning medium in the free space externally of said jets by induced flow of said ventilating medium adjacent said jets;

(g) providing ejector means in the form of an ejector or ejectors;

(h) supplying ventilating medium to said ejector means; and (i) directing said conditioned ventilating medium along a desired path without adversely affecting the condition by causing the velocity of said medium issuing from said ejector means to be high and the volume to be small compared with the veolocity and volume of the ventilating medium supplied by said main supply means.

2. The method of claim 1, wherein the said jets are provided in clusters.

3. The method of claim 1, wherein the said jets are provided in clusters of three jets.

4. Apparatus for controlling the condition of the atmosphere of a space, comprising:

(a) a main supply means exterior of said space for introducing ventilating medium into said space;

(b) an independent source of conditioning medium;

(c) means to condition the medium connected with said independent source externally of said space; and (d) a plurality of jets connected to said conditioning means by ducting, said jets being located in said space spaced from said main supply means and directed into said space whereby conditioned medium can issue from said jets into said space and induce a flow of said ventilating medium in the space to mix the ventilating medium and conditioning medium and condition the mixed medium as desired;

(e) ejector means spaced from said jets; and (f) means to supply ventilating medium to said ejector means, said ejector means issuing said ventilating medium at high velocity and low volume relative to the medium supplied by said main supply means to control the direction of said mixed medium without adversely affecting its condition.

5. The apparatus of claim 4, wherein said plurality of jets comprises three jets in a cluster.

6. The apparatus of claim 5, wherein there is a plurality of spaced clusters of jets.

7. The apparatus of claim 4, wherein said independent source comprises a fan and heating means of said conditioning medium.

8. The apparatus of claim 4, wherein said independent source comprises a fan and cooling means for said conditioning medium.

* * * * *

UNITED STATES PATENT AND TRADEMARK OFFICE

CERTIFICATE OF CORRECTION

PATENT NO. : 4,426,917

DATED : January 24, 1984

INVENTOR(S) :

It is certified that error appears in the above-identified patent and that said Letters Patent is hereby corrected as shown below:

Column 2, line 5, delete "(which is not shown)" and insert --15--;
line 8, after "source" insert --15--;
line 23, after "source" insert --15--;
line 26, delete "that" and insert --than--.

Signed and Sealed this

*Tenth* Day of *April 1984*

[SEAL]

*Attest:*

GERALD J. MOSSINGHOFF

*Attesting Officer*

*Commissioner of Patents and Trademarks*